US005080777A

United States Patent [19]

Aegerter, Jr. et al.

[11] Patent Number: 5,080,777

[45] Date of Patent: Jan. 14, 1992

[54] REFINING OF HEAVY SLURRY OIL FRACTIONS

[75] Inventors: Paul A. Aegerter, Jr., Bartlesville, Okla.; Jerald A. Howell, Lake Jackson, Tex.; Edward L. Sughrue, II; Kelly G. Knopp, both of Bartlesville, Okla.

[73] Assignee: Phillips Petroleum Company, Bartlesville, Okla.

[21] Appl. No.: 516,863

[22] Filed: Apr. 30, 1990

[51] Int. Cl.[5] ..... C10G 51/04

[52] U.S. Cl. ..... 208/74; 208/68; 208/73; 208/85; 208/100

[58] Field of Search ..... 208/67, 73, 85, 100, 208/68, 56, 74

[56] References Cited

U.S. PATENT DOCUMENTS

| | | | |
|---|---|---|---|
| 2,559,285 | 7/1951 | Douce | 196/14.11 |
| 2,939,836 | 6/1960 | Koome et al. | 208/112 |
| 3,349,023 | 10/1967 | Paterson | 208/68 |
| 3,728,251 | 4/1973 | Kelly et al. | 208/89 |
| 3,738,931 | 6/1973 | Frankovich et al. | 208/67 |
| 3,983,029 | 9/1976 | White | 208/59 |
| 4,082,648 | 4/1978 | Murphy | 208/97 |
| 4,207,167 | 6/1980 | Bradshaw | 208/68 |
| 4,426,276 | 1/1984 | Dean et al. | 208/60 |
| 4,443,325 | 4/1984 | Chen et al. | 208/55 |
| 4,462,895 | 7/1984 | Biceroglu et al. | 208/73 |
| 4,560,467 | 12/1985 | Stapp | 208/73 |
| 4,565,620 | 1/1986 | Montgomer et al. | 208/80 |
| 4,608,152 | 8/1986 | Howell et al. | 208/108 |
| 4,615,791 | 10/1986 | Choi et al. | 208/56 |
| 4,659,453 | 4/1987 | Kukes et al. | 208/108 |
| 4,802,971 | 2/1989 | Herbst et al. | 208/73 |

*Primary Examiner*—Anthony McFarlane
*Attorney, Agent, or Firm*—George E. Bogatie

[57] ABSTRACT

For upgrading heavy slurry oil containing catalyst fines from a catalytic cracking operation, the viscosity of the slurry oil is lowered in a hydrovisbreaking process step. In a preferred embodiment an admixture of the fines containing slurry oil and a metal containing resid oil fraction, resulting from a crude distillation, is passed through the hydrovisbreaker. The hydrovisbreaker effluent is separated into higher and lower boiling fractions with the lower boiling fraction preferably passed through a cracking unit so as to covert the lower boiling fraction to lower molecular weight hydrocarbon products.

19 Claims, 2 Drawing Sheets

REFINING OF HEAVY SLURRY OIL FRACTIONS

This invention relates to upgrading heavy hydrocarbon-containing oils. In one aspect it relates to a process for upgrading selected heavy fractions of crude oil admixed with residual slurry oil from a catalytic cracking operation. In another aspect it relates to an integrated combination process in which catalytic cracking, hydrocracking, and hydrovisbreaking are advantageously combined to improve the yield of desired products from cracked slurry oil and other heavy hydrocarbon containing oil.

Many different process steps, such as distillation, cracking, extraction, visbreaking, desulfurization, hydrogenation, dehydrogenation, extraction, etc., may be involved in the refining of crude oil to produce a desired product such as gasoline. The two most common process steps in the refining of crude oil, however, are fractional distillation and catalytic cracking.

The heaviest fraction resulting from a fractional distillation operation, which is generally referred to as residuum or residual oil, is rich in coke precursors and also contains high levels of metals such as iron, nickel, and vanadium. When residual oil is charged to a catalytic refining process, such as catalytic cracking, an undesirably high level of hydrogen and coke formation occurs in the catalytic reaction zone. This coke tends to deposit on the catalyst and reduce the catalytic activity for producing the desired reaction. Also, the metals tend to deposit on the catalyst and further reduce the desired catalytic activity and selectivity.

Even in view of these drawbacks, refiners, who are faced with the need to reduce imports by fully processing available feedstock, frequently utilize residual oil fractions containing the above mentioned impurities as feedstock for fluid catalytic cracking units (FCCU).

It is well known, however, to alleviate the above mentioned problems by employing hydrogen to treat the heavy liquid hydrocarbon containing oils so as to remove impurities such as metals, sulfur and nitrogen which are present in the heavy oil. Another advantageous process step is hydrovisbreaking, which is used to break or lower the viscosity of a high viscosity residuum by thermal cracking of molecules in the presence of molecular hydrogen and at relatively low temperatures over relatively long periods of time.

Heavy oil fractions which contain undesirable metal impurities and which also contain significant amounts of cokeable material, i.e. Ramsbottom carbon residual, can be hydrotreated so as to provide a heavy oil feedstock of lower metal content as well as lower Ramsbottom carbon residue for catalytic cracking. With the hydrotreated feedstock charged to the catalytic cracking operation, the yield of lower molecular weight products from the catalytic cracking operation is improved.

The above mentioned hydrotreating processes, which remove impurities and/or reduce viscosity, and which are typically carried out in the presence of suitable heterogeneous catalyst beds, have proven to be effective process step for improving the suitability of heavy oil streams from crude distillation operations for charging to catalytic cracking operations. These above mentioned hydrotreating processes, however, are not suitable for treating the heaviest FCCU residual fractions such as decant oil and residual slurry oil. This is because these FCCU fractions consist of a mixture of liquids and solid catalyst fines, which are about 10 to 40 microns in diameter, and would lead to plugging of a fixed catalyst bed reactor utilized in a hydrotreating operation. In the past, however, these heavy FCCU slurry fractions have been recycled to the catalytic cracking unit without the benefit of hydrotreating, and with the resulting loss of catalyst activity, and an increase in the yield of higher molecular weight products.

It is therefore an object of this invention to improve the suitability of heavy FCCU slurry oil fractions for recycle so as to convert much of the heavy slurry oil into gasoline.

It is a further object of this invention to integrate selected process steps so as to more efficiently process heavy hydrocarbon containing oil to obtain improved yields of hydrocarbon products boiling in the gasoline range.

SUMMARY OF THE INVENTION

In accordance with this invention a process for the conversion of heavy hydrocarbon-containing oil comprises:

(a) passing a feed material comprising a slurry oil containing dispersed cracking catalyst fines, preferably admixed with a metal containing oil, through a hydrovisbreaker so as to reduce the viscosity of the feed material;

(b) separating the hydrovisbreaker effluent into at least one lower boiling fraction and a higher boiling fraction, wherein the higher boiling fraction contains the dispersed cracking catalyst fines; and (c) passing the at least one lower boiling fraction through a cracking unit so as to convert the lower boiling fraction to lower molecular weight hydrocarbon products.

In a preferred embodiment of this invention, an integrated combination refining process comprises hydrovisbreaking followed by catalytic cracking, either with or without the presence of added reactant hydrogen, is employed to more efficiently convert heavy hydrocarbon containing oils into gasoline. In the integrated process, a heavy hydrocarbon containing oil is processed according to this invention. Preferably the heavy hydrocarbon containing oil to be processed includes a heavy residual oil fraction resulting from a crude oil distillation and which contains impurities such as metals, sulfur, nitrogen, and Ramsbottom carbon residue. This crude oil distillation residual is admixed with a heavy residual slurry oil fractions, containing solid catalyst fines, to form a feed material which is treated in the hydrovisbreaker unit. Preferably the heavy slurry oil fractions comprise decant oil and residual slurry oil fractions from the FCCU, which are recycled to the hydrovisbreaker unit, wherein the volume ratio of recycle slurry oil to new heavy oil is preferably from about 1:10 to about 1:1. The viscosity and concentration of metal, sulfur and nitrogen impurities of the feed material are reduced in a slurry type hydrovisbreaker, which is operated without a fixed catalyst bed.

In the preferred hydrovisbreaking operation, a decomposable additive for reducing the concentration of metals, sulfur, nitrogen, and Ramsbottom carbon residue is contacted with the heavy hydrocarbon-containing feed material and hydrogen under hydrovisbreaking conditions in a slurry type reaction, i.e. in the absence of solid support for the decomposable additive. The effluent from the hydrovisbreaker is separated into at least one low boiling fraction and a high boiling fraction, and the low boiling fraction is optionally hydrotreated for further reducing impurities prior to being charged to the catalytic cracking unit.

DETAILED DESCRIPTION OF THE INVENTION

Figure 1:
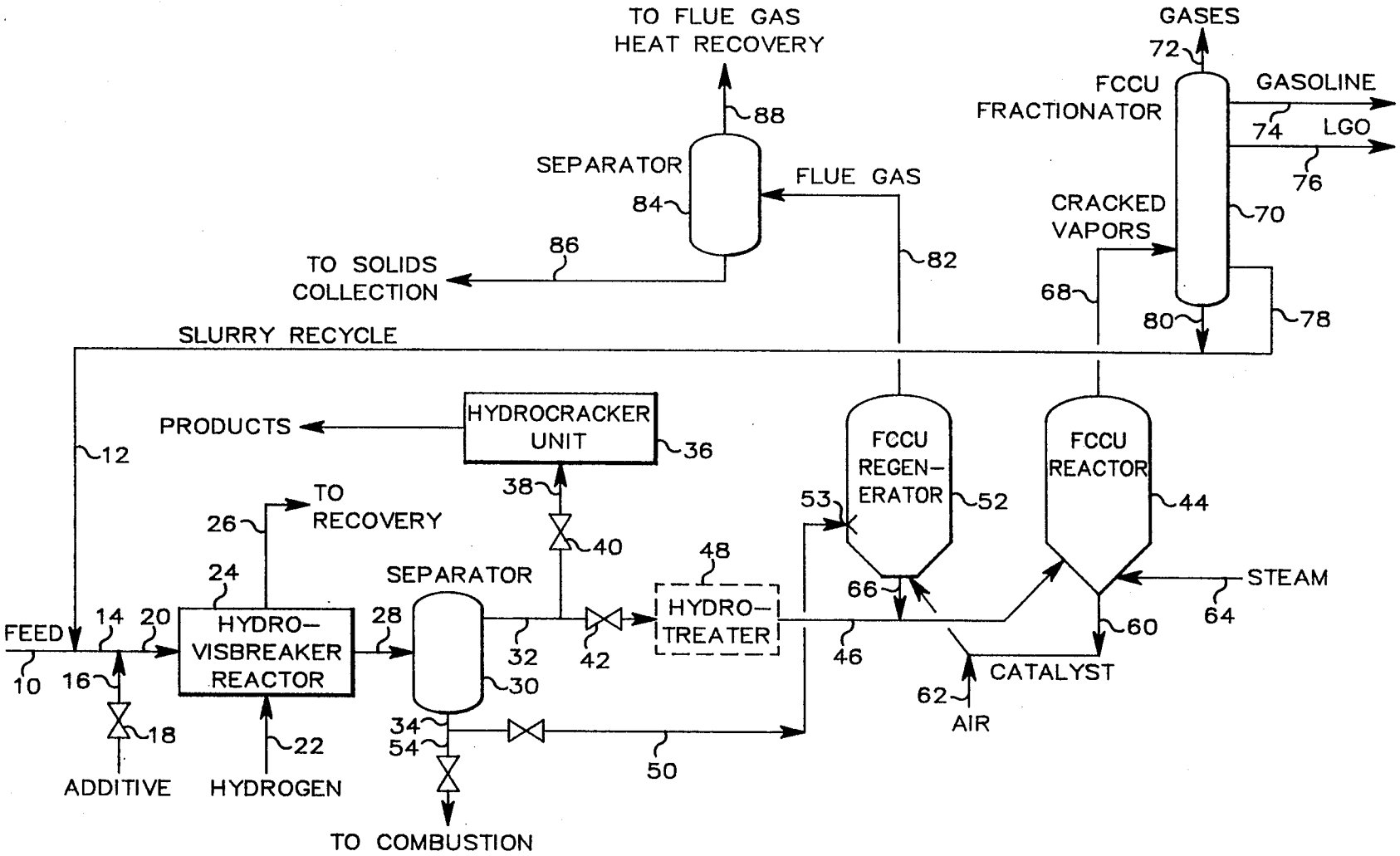
FIG. 1 is a simplified schematic flow diagram illustrating the process steps of the invention and the products produced therefrom.

Any processable hydrocarbon containing feed stream, which is substantially liquid at the hydrovisbreaking condition and which contains dispersed cracking catalyst fines in addition to impurity compounds of metals, in particular nickel and vanadium, can be employed in the process of this invention. Generally these feed streams also contain coke precursors, measured as Ramsbottom carbon residue (ASTM Method D524), sulfur and nitrogen as impurities. Such feed streams contain decant oil and/or residual slurry oil from catalytic cracking operations.

Additionally such feed streams may contain petroleum products, coal, pyrolyzates, products from extraction and/or liquefication of coal and lignite, products from tar sands, products from shale oil and similar products. Other suitable feed streams include full range (untopped) crudes, gas oil having a boiling range from about 400° F. to about 1000° F., topped crude having a boiling range in excess of about 650° F. and residuum. However, the present invention is particularly directed to heavy feed streams which are mixtures of decant and/or residual slurry oil and heavy full range crudes, heavy topped crudes and residuum and other materials which are generally regarded as too heavy to be distilled. These materials will generally contain the highest concentrations of metals, sulfur, nitrogen and Ramsbottom carbon residues present in hydrocarbon-containing material.

Preferably the Ramsbottom carbon residue content of the crude distillation residual, which is included in feed material, exceeds about 1 weight %, and more preferably is in the range of about 2–30 weight %. Preferably the crude distillation residual material also contains about 3–500 ppmw nickel (parts by weight of Ni per million parts by weight of feed) and about 5–1000 ppmw vanadium, more preferable about 5–30 ppmw nickel and about 10–500 ppmw vanadium. Generally, the crude distillation residual also contains about 0.2–6 weight-% sulfur, about 0.1 weight-% nitrogen and 1–99 weight-% of materials boiling in excess of about 1000° F. under atmospheric pressure conditions. Preferably the API gravity (measured at 60° F.) of the feed ranges from about 4 to about 30, and the amount of heavies boiling above 1000° F. at atmospheric pressure is in the range of from about 5 to about 99 weight-%.

The free hydrogen containing gas used in the hydrovisbreaking process step of this invention can be substantially pure hydrogen gas or can be a mixture of hydrogen with at least one other gas such as nitrogen, helium, methane, ethane, carbon monoxide, hydrogen sulfide and the like. At present substantially pure hydrogen gas is preferred.

A number of different hydrovisbreaking processes are known for use in the present invention. A preferred hydrovisbreaking process which employs an additive comprising a decomposable molybdenum compound which is mixed with the hydrocarbon containing feed stock for reducing concentrations of metals, sulfur, nitrogen and Ramsbottom carbon residue is disclosed U.S. Pat. No. 4,608,152 issued to Howell, et al. The disclosure of which is herein incorporated by reference.

Another hydrovisbreaking processes, within the scope of the invention, may employ a dispersed hydrovisbreaking catalyst such as Mo on alumina or silica. This catalyst is mixed with the feed material in the hydrovisbreaking process and then accompanies the hydrovisbreaking product to the catalytic cracking process step where the hydrovisbreaking catalyst is removed in the catalytic cracking operation along with the catalytic cracking catalyst.

In yet another suitable hydrovisbreaking process no externally supplied additive or catalyst is employed. Instead, the catalytic cracking catalyst fines, contained in the slurry oil fraction, are relied upon to increase conversion rate in the hydrovisbreaking process. The catalyst fines in the hydrovisbreaker effluent can then be separated, on a once through basis, along with the unconverted residual oil from the hydrovisbreaker.

The hydrovisbreaking process can be carried out in any suitable apparatus whereby there is achieved a contact of a hydrocarbon containing feed stream, and hydrogen, and preferably a decomposable molybdenum compound, under suitable hydrovisbreaking conditions. The hydrovisbreaking process can be carried out as a continuous process or as a batch process. The hydrovisbreaking process is in no way limited to the use of any particular type of apparatus.

Any suitable reaction time in the hydrovisbreaking process may be utilized. In general, the reaction time will range from about 0.01 hours to about 10 hours. Preferably, the reaction time will range from about 0.25 hours to about 3 hours. Thus for a continuous process, the flow rate of the hydrocarbon containing feed stream should be such that the time required for the passage of the mixture through the reactor (residence time) will preferably be in the range of about 0.1 to about 3 hours.

The hydrovisbreaking process can be carried out at any suitable temperature. The temperature will generally be in the range of about 500° F. to about 1000° F. and will preferably be in the range of about 700° F. to about 900° F. Higher temperatures do improve the removal of metals but temperatures should not be utilized which will have adverse effects on the hydrocarbon containing feed stream, such as increased coking. Also economic considerations must be taken into account in selecting the operating temperature. Lower temperatures can generally be used for lighter feeds.

Any suitable hydrogen pressure may be utilized in the hydrovisbreaking process. The reactor pressure will generally be in the range of about atmospheric to about 10,000 psig. Preferably, the pressure will be in the range of about 500 to about 3,000 psig. Higher hydrogen pressures tend to reduce coke formation but operation at higher pressure may have adverse economic consequences.

Any suitable quantity of hydrogen can be added to the hydrovisbreaking process. The quantity of hydrogen used to contact the hydrocarbon containing feed stock, either in a continuous or batch process, will generally be in the range of about 100 to about 20,000 standard cubic feet per barrel of feed.

As previously stated, the reaction effluent from the hydrovisbreaking process is separated into at least one lower boiling fraction and a higher boiling fraction which contains the dispersed cracking catalyst fines. In accordance with this invention, a lower boiling fraction is subjected to catalytic cracking, either with or without the presence of added reactant hydrogen. The higher boiling fraction, which contains the dispersed catalyst fines, may be utilized as a fuel or may be subjected to catalytic cracking. In a preferred embodiment the higher boiling fraction is burned in the regenerator of the fluid catalytic cracking unit or catalytic hydrocracking unit.

According to this invention, the catalytic cracking process step treats a heavy oil fraction which is relatively low in metal compounds because of the hydrovisbreaking treatment. The catalytic cracking process can be carried out in any conventional manner known by those skilled in the art so as to provide lower boiling hydrocarbon products from the heavy oil feed.

Any suitable reactor can be used for the catalytic cracking process step of this invention. Generally a fluidized-bed catalytic cracking (FCC) reactor, preferably containing one or two or more risers, or a moving bed catalytic cracking reactor, e.g. a Thermofor catalytic cracker, is employed. Presently preferred is a FCC riser cracking unit containing a cracking catalyst. Especially preferred cracking catalysts are those containing a zeolite imbedded in a suitable matrix, such as alumina, silica, silica-aluminia, aluminum phosphate, and the like. Examples of such FCC cracking units are described in U.S. Pat. Nos. 4,377,470 and 4,424,116.

The cracking catalyst composition that has been used in the cracking process (commonly called "spent" catalyst) contains deposits of coke and metals or compounds of metals, in particular nickel and vanadium compounds. The spent catalyst is generally removed from the cracking zone and then separated from formed gases and liquid products by any conventional separation means (e.g. a cyclone separator), as is described in the above-cited patents and also in a text entitled "Petroleum Refining" by James H. Gary and Glenn E. Handwerk, Marcel Dekker, Inc., 1975.

Adhered liquid oil is generally stripped from the spent catalyst by flowing steam, preferably having a temperature of about 700° F. to 1,500° F. The steam stripped catalyst is generally heated in a free oxygen-containing gas stream in the regeneration unit associated with the cracking reactor, as is shown in the above cited references, so as to produce a regenerated catalyst. Generally, air is used as the free oxygen containing gas; and the temperature of the catalyst during regeneration with air preferably is about 1100° F.-1400° F. Substantially all coke deposits are burned off and metal deposits, in particular vanadium compounds, are at least partially converted to metal oxides during regeneration. Enough fresh, unused catalyst is generally added to the regenerated cracking catalyst so as to provide a so-called equilibrium catalyst of desirably high cracking activity. At least a portion of the regenerated catalyst, preferably equilibrium catalyst, is generally recycled to the cracking reactor. Preferably the recycled regenerated catalyst is transported by means of a suitable lift gas stream (e.g. steam) to the cracking reactor and introduced to the cracking zone, with or without the lift gas.

Specific operating conditions of the cracking operation depend greatly on the type of feed, the type and dimensions of the cracking reactor and the oil feed rate. Examples of operating conditions are described in the above-cited references and in many other publications. In an FCC operation, generally the weight ratio of catalyst composition to oil feed (i.e. hydrocarbon-containing feed) ranges from about 2:1 to about 10:1, the reactor space velocity is in the range of about 1.1 to about 13.4 lb./hr./lb., and the cracking temperature is in the range of from about 800° F. to about 1200° F. Generally steam is added with the oil feed to the FCC reactor so as to aid in the dispersion of the oil as droplets. Generally the weight ratio of steam to oil feed is in the range of from about 0.01:1 to about 0.5:1.

The hydrocracking process step, which may alternatively be employed in this invention to take the more difficultly cracked material, is carried out in any conventional manner. The hydrocracking process step is similar to the catalytic cracking process step described above, but generally employs higher pressure and a hydrogen atmosphere. Non-limiting examples of operating conditions and suitable catalysts for the hydrocracking process step are described in the text "Petroleum Refining" cited above. Specific examples of operating conditions include temperatures ranging from 500° to 800° F. and pressure ranges from 1000 to 2000 psig. However, the temperature and pressure vary with the age of the catalyst, the product desired and the properties of the feed material.

The separation of liquid products, resulting from the catalytic cracking operation, into various gaseous and liquid product fractions can be carried out by any conventional separation means, generally by fractional distillation. The most desirable product fraction is gasoline (ASTM boiling range: about 180° F.-400° F.). A slurry oil fraction is withdrawn from the fractionator in a bottoms stream, and in accordance with this invention is recycled to the hydrovisbreaker. Characteristic properties of a typical slurry oil from a commercial FCCU operation are given in Example 1, hereinafter. Non-limiting examples of such separation schemes are illustrated in the text "Petroleum Refining," cited above.

Further in accordance with this invention, the hydrovisbreaker effluent stream, which has been upgraded so as to contain relatively low quantities of impurities of metals, sulfur and nitrogen, is optionally even further upgraded in an additional hydrotreating operation prior to the catalytic cracking operation. Various hydrotreating processes which are described in the text "Petroleum Refining" cited above, are suitable for use in the present invention.

The hydrotreating process step of this invention can be carried out in any apparatus whereby an intimate contact of a hydrotreating catalyst bed with the hydrovisbreaker effluent stream and a free hydrogen containing gas is achieved, under such conditions as to produce a hydrocarbon-containing effluent stream having reduced levels of metals (in particular nickel and vanadium) and reduced levels of sulfur, and a hydrogen-rich effluent stream. Generally, a lower level of nitrogen and Ramsbottom carbon residue and higher API gravity are also attained in this hydrotreating process.

The hydrotreating process step of this invention can be carried out as a batch process or, preferably, as a continuous down-flow or up-flow process, more preferably in a tubular reactor containing one or more fixed catalyst beds, or in a plurality of fixed bed reactors in parallel or in series. The hydrocarbon containing product stream from the hydrotreating step can be cracked and then distilled, e.g. in a fractional distillation unit, so as to obtain fractions having different boiling ranges.

Any suitable reaction time between the catalyst, the hydrocarbon-containing feed stream, the and hydrogen-containing gas can be utilized. In general the reaction time will be in the range of from about 0.05 hours to about 10 hours, preferably from about 0.4 hours to about 5 hours. In a continuous fixed bed operation, this generally requires a liquid hourly space velocity (LHSV) in the range of from about 0.10 to about 10 volume (V) feed per hour volume of catalyst, preferably from about 0.2 to about 2.5 V/Hr/V.

The hydrotreating process employing a fixed bed catalyst of the present invention can be carried out at any suitable temperature. The reaction temperature will generally be in the range of from about 482° F. to about 1022° F. and will preferably be in the range of about 572° F. to about 842° F. to minimize cracking. Higher temperatures do improve the removal of impurities, but temperatures which will have adverse effects on the hydrocarbon containing feed stream, such as excessive coking, will usually be avoided. Also, economic considerations will usually be taken into account in selecting the temperature.

Any suitable pressure may be utilized in the hydrotreating process. The reaction pressure will generally be in the range from about atmospheric pressure to up to 5000 psig pressure. Preferably, the pressure will be in the range of from about 100 to about 2500 psig. Higher pressures tend to reduce coke formation, but operating at high pressure may be undesirable for safety and economic reasons.

Any suitable quantity of free hydrogen can be added to the hydrotreating process. The quantity of hydrogen used to contact the hydrocarbon containing feed stream will generally be in the range of from about 100 to about 10,000 scf hydrogen per barrel of hydrocarbon containing feed, and will more preferably be in the range of from about 1,000 to about 5,000 scf of hydrogen per barrel of the hydrocarbon containing feed stream. Either pure hydrogen or a free hydrogen containing gaseous mixture e.g. hydrogen and methane, hydrogen and carbon monoxide, or hydrogen and nitrogen can be used.

There are a number of hydrotreating catalysts available, which are suitable for use in the present invention, and the actual catalyst composition is tailored to the process, feed material composition, and the products desired. The preferred catalyst for hydrotreating a substantially liquid heavy hydrocarbon-containing feed stream which also contains sulfur and metal components as previously described, comprises a typical hydrotreating catalyst. Generally, these hydrotreating catalysts comprises alumina, optionally combined with titania, silica, alumina phosphate, and the like, as support materials, and compounds of at least one metal selected from the groups consisting of molybdenum, tungsten, iron, cobalt, nickel and copper as promoters.

Referring now to FIG. 1, which is a simplified schematic representation of the preferred process flow of this invention, a heated oil feed stream in conduit 10 is combined with a slurry oil recycle stream in conduit 12 to form a combined stream in conduit 14. Preferably a decomposable metal compound (additive) is blended with the combined stream in conduit 14, via conduit 16 and valve 18, to form a feed mixture stream in conduit 20. The feed mixture stream in conduit 20 is charged, along with a free hydrogen containing gas stream via conduit 22, to a hydrovisbreaking reactor 24. If it is not desired to supply a decomposable metal compound to the hydrovisbreaker reactor 44, valve 18 will be closed.

Gaseous product and unconsumed hydrogen, which may be recovered (not illustrated), exit the hydrovisbreaker reactor 24 through conduit 26 and liquid products exit the reactor 24 through conduit 28. The liquid products in conduit 28 are sent to a separator 30, which may be any suitable liquid-liquid type separator, and are separated into at least one lower boiling fraction which is illustrated as being withdrawn through conduit 32 (and optionally through additional conduits such as conduit 33), and a higher boiling fraction which is withdrawn through conduit 34.

The liquid intermediate stream withdrawn from separator 30 through conduit 32 is utilized as a cracking charge stock. In one embodiment the liquid intermediate stream may be sent to a hydrocracker unit 36 through conduit 38 if valve 40 is open and valve 42 is closed. In another alternative embodiment, the liquid intermediate is sent to the FCCU reactor 44 through conduit 46 if valve 40 is closed and valve 42 is open. Optionally the liquid cracking stock can be passed through hydrotreater reactor 48 to achieve reduction of impurities prior to catalytic cracking in FCCU reactor 44.

The liquid withdrawn from separator 30 through conduit 34, which as previously stated contains dispersed cracking catalyst fines, may be passed through conduit 50 and subjected to catalytic cracking or alternately passed through conduit 54 for combustion at a suitable site of utilization. Preferably the heavy oil containing catalyst fines, is burned through a torch oil inlet 53 of FCCU regenerator 52.

Referring now to the FCCU reactor 44 and catalyst regenerator 52 illustrated in FIG. 1, used, or so-called spent catalyst, is withdrawn from reactor 44 through conduit 60 and passed together with air or other oxygen containing gas supplied through conduit 62 to regenerator 52. Before the spent catalyst enters the regenerator, hydrocarbons which are adsorbed on the surface of the spent catalyst are removed (e.g. stripped) by steam supplied through conduit 64.

Regenerated cracking catalyst supplied through conduit 66 is mixed with the cracking stock in conduit 46 and this mixture is charged to the FCCU reactor 44. Cracked hydrocarbon vapors are withdrawn from reactor 44 through conduit 68 and sent to the FCCU fractionator 70 for separation into liquid and gaseous products. Fractionator 70 yields the usual light gases which are taken off through conduit 72, gasoline which is taken off through conduit 74, heavier hydrocarbons (light gas oil, heavy gas oil) which are taken off through conduits 76 and 78, and slurry oil which is withdrawn through conduit 80. The slurry oil flowing in conduit 80, which contain the dispersed catalysts fines, is provided to conduit 12, and in accordance with this invention is recycled to the hydrovisbreaker reactor 24.

Flue gas produced in regenerator 52, which also may contain dispersed catalyst fines, is passed via conduit 82 to a suitable separator 84 where catalyst fines are separated from the flue gas and withdrawn through conduit 86, and hot flue gas is passed through conduit 88 for recovery of waste heat.

The conditions for the several process operations illustrated in FIG. 1 have been previously described and also are generally well known in the art. Optimum conditions for the operations of the combination of processes illustrated in FIG. 1 can be selected by one skilled in the art, in possession of this disclosure, dependent on the particular feed being processed and the products desired.

The following examples are presented in further illustration of the invention.

EXAMPLE I

In this example the experimental setup and the effect of hydrovisbreaking on the boiling range of heavy cracked oils, which are subjected to a batch-type hydrovisbreaking treatment, are illustrated.

About 100 grams of an FCCU slurry oil, containing catalyst fines, and characterized as follows: an API gravity of 6.0; Ramsbottom carbon weight percent 6.7, and containing 0.29 weight percent nitrogen; 0.81 weight percent S; 88.6 weight percent carbon; and 9.31 weight percent hydrogen. To the 100 grams of slurry oil, enough Molyvan® L, a molybdenum dithiophosphate catalyst from R. T. Vanderbilt Co, Norwalk, Conn., was added so as to give a molybdenum content in the oil of 150 ppmw Mo, and the slurry was contained in a 300 cc stirred autoclave (Autoclave Engineers, Inc., Erie, Pa), which was preheated to about 200° F. The autoclave unit was sealed, alternately pressured with hydrogen and vented so as to eliminate air, and finally pressured with hydrogen to the desired starting pressure (about 1400 psig). Stirring at about 1000 rpm and rapid heating up to the various test temperatures starting at about 800° F. was carried out. During the test run hydrogen gas was added so as to maintain a constant pressure of about 2,250 psig at the selected test temperature.

After heating at the selected test temperature for about 180 minutes, the autoclave unit was cooled as quickly as possible, depressurized and opened. The liquid product was collected and analyzed to determine a boiling point curve for the heavy oil treated in the hydrovisbreaker.

Figure 2:
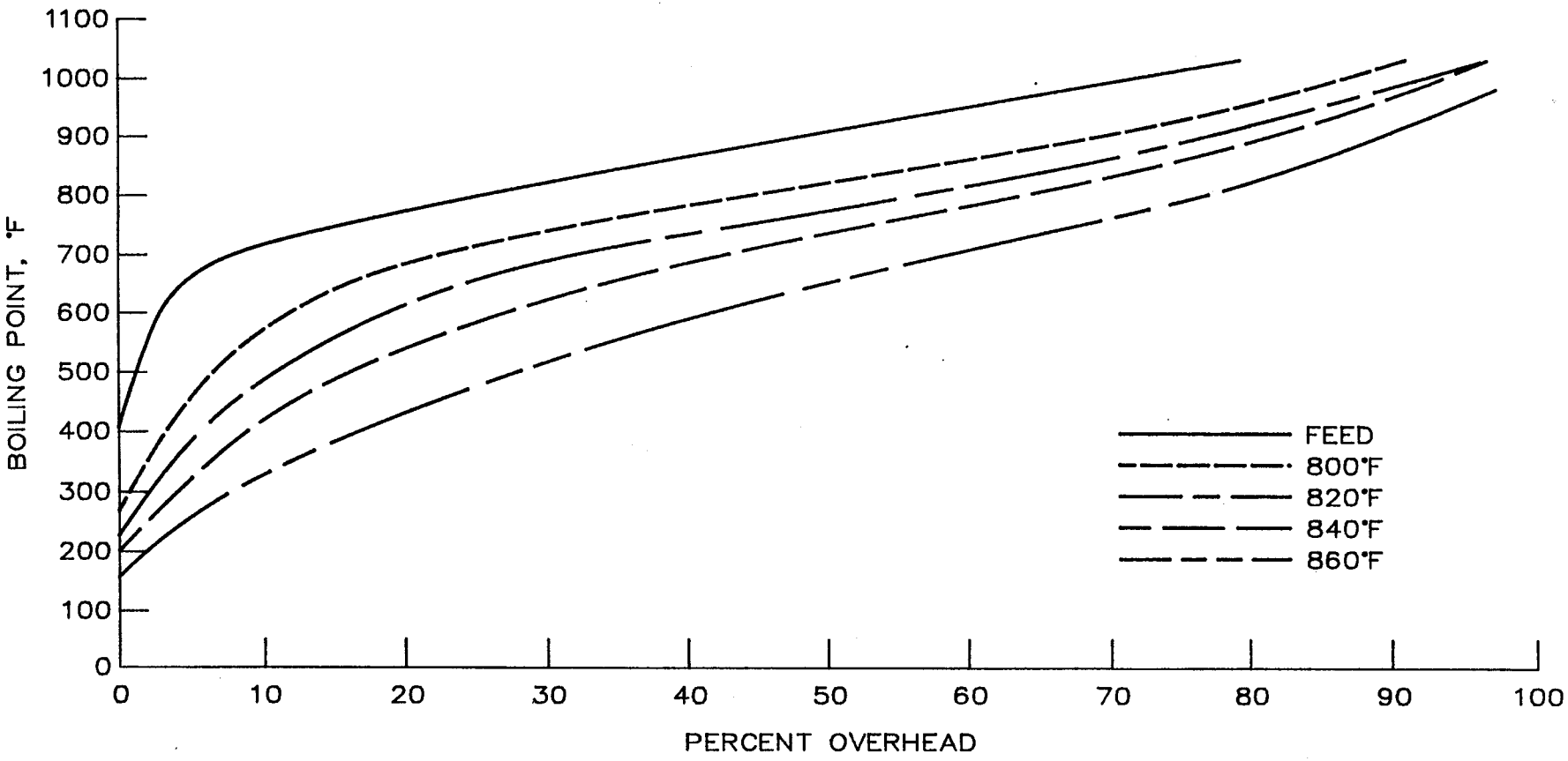
FIG. 2 graphically illustrates the effect of hydrovisbreaking on the boiling range in accordance with the this invention.

This procedure was repeated by subjecting a sample of the same heavy slurry oil to hydrovisbreaking but at a different temperature. The results illustrating the effect of hydrovisbreaking for the heavy oil at various temperatures is illustrated in FIG. 2. The curves illustrated in FIG. 2 show that hydrovisbreaking of the heavy slurry oil, with the molybdenum additive, substantially increased the quantity of lower boiling material compared to the untreated slurry oil.

EXAMPLE II

This example illustrates the experimental setup used to obtain results of cracking heavy slurry oil. A micro confined-bed laboratory unit, which is a quartz reactor system for fluid catalytic cracking of oils, was charged with about 35 grams of a suitable cracking catalyst. Nitrogen was utilized as the fluidizing gas during the reaction, and air was utilized as the oxygen containing fluid for catalyst regeneration.

The heavy oil was introduced at about one inch above the catalyst bed through a moveable tube and was injected over a thirty second time period. Cracked products were collected in a trap maintained at 32° F. and also in a gas receiver at room temperature. Reaction temperature was 950° F., and the regeneration temperature was 1,250° F. Stripping time was about 5 minutes.

Liquid and gaseous products were collected and analyzed by chromatography. The gasoline end point was set at 430° F. Coke was determined by weighing the reactor plus catalyst before and after catalyst regeneration, since the catalyst was regenerated for extinction of coke on the catalyst. The material balance of each accepted run was required to be 100 plus or minus 5%, and the reported results were normalized to 100% material balance.

EXAMPLE III

This example illustrates the effectiveness of the overall combination process comprising hydrovisbreaking and catalytic cracking in accordance with the procedures outlined in EXAMPLE I and EXAMPLE II. In this example the oils treated in the hydrovisbreaker (Example I) were subjected to catalytic cracking (Example II). The test results showing the product distribution are summarized in Table I.

TABLE I

Effect of Hydrovisbreaking on Product Distribution

| [1]Run | 1 | 2 | 3 | 4 | 5 |
|---|---|---|---|---|---|
| HVB temp, °F. | NONE | 800 | 820 | 840 | 860 |
| $C_1$ to $C_4$, wt-% | 9.2 | 9.3 | 8.7 | 9.9 | 9.9 |
| Gasoline, wt-% | 21.2 | 25.3 | 23.7 | 22.1 | 24.1 |
| LCO, wt-% | 13.3 | 23.4 | 27.7 | 30.2 | 34.2 |
| HCO, wt-% | 27.3 | 22.1 | 18.0 | 18.6 | 14.4 |
| Coke, wt-% | 29.0 | 19.9 | 21.9 | 19.3 | 17.5 |
| [2]$H_2$ make, SCFB | 404 | 303 | 315 | 265 | 211 |

Notes: [1]Untreated slurry oil was cracked in Run no. 1.
[2]Based on barrels of slurry oil supplied to the hydrovisbreaker, but does not include hydrogen consumption in the hydrovisbreaking process.

The results in Table I illustrate significantly lower yield of heavy cycle oil, coke and hydrogen, with improved yields of gasoline and light cycle oil for the heavy oil processed according to this invention.

Reasonable variations and modifications of this invention are possible by those skilled in the art, and such variations and modifications are within the scope of the disclosure and the appended claims.

That which is claimed is:

1. A process for the conversion of heavy hydrocarbon containing oil comprising:
   (a) passing a feed material having zeolite-containing cracking catalyst fines dispersed therein, through a hydrovisbreaker so as to reduce the viscosity of said feed material;
   (b) separating effluent of said hydrovisbreaker into at least one lower boiling fraction and a higher boiling fraction, wherein said higher boiling fraction contains said dispersed cracking catalyst fines; and
   (c) passing said at least one lower boiling fraction through a cracking unit so as to convert said at least one lower boiling fraction into lower molecular weight hydrocarbon products.

2. A process in accordance with claim 1 wherein said feed material comprises a mixture of a slurry oil having zeolite-containing cracking catalyst fines dispersed therein, and a heavy oil which contains metal and sulfur impurities.

3. A process in accordance with claim 1 wherein said cracking unit comprises a fluid catalytic cracking unit having a cracking reactor, a catalyst regenerator, and an associated fractionator.

4. A process in accordance with claim 3 wherein said slurry oil, having zeolite-containing cracking catalyst fines dispersed therein, comprises a residual fraction which is recycled to said hydrovisbreaker from said fractionator associated with said catalytic cracking unit, and said heavy oil, which contains metals and sulfur impurities, comprises a residual heavy oil fraction resulting from a crude oil distillation.

5. A process in accordance with claim 4 wherein the ratio of said slurry oil to said residual heavy oil fraction is from about 1:10 to about 1:1.

6. A process in accordance with claim 1 wherein said cracking unit comprises a hydrocracker unit.

7. A process in accordance with claim 1 additionally comprising the following step:

introducing a decomposable molybdenum additive into said feed material prior to said step of passing said feed material through said hydrovisbreaker:

contacting said feed material containing said decomposable molybdenum additive under hydrovisbreaking conditions with hydrogen, wherein said contacting is carried out in the absence of a solid support for said decomposable molybdenum additive.

8. A process in accordance with claim 7 wherein said decomposable molybdenum additive is selected from the group consisting of molybdenum dithiophosphates, molybdenum dithiocarbamates, molybdenum carboxylates, and mixtures thereof.

9. A process in accordance with claim 1 additionally comprising the following step:

introducing a hydrovisbreaking catalyst comprising molybdenum on alumina into said feed material, wherein said hydrovisbreaking catalyst is dispersed in said feed material, wherein said hydrovisbreaking catalyst functions to reduce the concentration of sulfur, nitrogen and Ramsbottom carbon residue present in said feed material.

10. A process in accordance with claim 1 additionally comprising the following step:

introducing a decomposable molybdenum additive into said feed material prior to said step of passing said feed material through said hydrovisbreaker:

contacting said feed material containing said decomposable molybdenum additive under hydrovisbreaking conditions with hydrogen, wherein said contacting is carried out in the absence of a solid support for said decomposable molybdenum additive.

11. A process in accordance with claim 10 wherein said decomposable molybdenum additive is selected from the group consisting of molybdenum dithiophosphates, molybdenum dithiocarbamates, molybdenum carboxylates, and mixtures thereof.

12. A process for the conversion of heavy hydrocarbon containing oil comprising:

(a) passing a feed material, having zeolite-containing cracking catalyst fines dispersed therein, through a hydrovisbreaker so as to reduce the viscosity of said feed material;

(b) separating effluent of said hydrovisbreaker into at least one lower boiling fraction and a higher boiling fraction in a separator, wherein said higher boiling fraction contains said dispersed cracking catalyst fines;

(c) withdrawing said at least one lower boiling fraction from said separator as a product stream; and (d) passing said higher boiling fraction containing dispersed cracking catalyst fines through a catalytic cracking unit so as to convert said higher boiling fraction into lower molecular weight hydrocarbon products.

13. A process in accordance with claim 12 wherein said feed material comprises a mixture of a slurry oil having zeolite-containing cracking catalyst fines dispersed therein, and a heavy oil which contains metal and sulfur impurities.

14. A process in accordance with claim 12 wherein said cracking unit comprises a fluid catalytic cracking unit having a cracking reactor, a catalyst regenerator, and an associated fractionator.

15. A process in accordance with claim 14 wherein said slurry oil, having zeolite-containing cracking catalyst fines dispersed therein, comprises a residual fraction which is recycled to said hydrovisbreaker from said fractionator associated with said catalytic cracking unit, and said heavy oil, which contains metal and sulfur impurities, comprises a residual heavy oil fraction resulting from a crude oil distillation.

16. A process in accordance with claim 15 where in the ratio of said slurry oil to said residual heavy oil fraction is from about 1:10 to about 1:1.

17. A process in accordance with claim 12 additionally comprising the following step:

introducing a hydrovisbreaking catalyst comprising molybdenum on alumina into said feed material, wherein said hydrovisbreaking catalyst is dispersed in said feed material, wherein said hydrovisbreaking catalyst functions to reduce the concentration of sulfur, nitrogen and Ramsbottom carbon residue present in said feed material.

18. A process for the conversion of heavy hydrocarbon containing oil comprising:

(a) passing a feed material, having zeolite-containing cracking catalyst fines dispersed therein, through a hydrovisbreaker so as to reduce the viscosity of said feed material;

(b) separating effluent of said hydrovisbreaker into at least one lower boiling fraction and a higher boiling fraction wherein said higher boiling fraction contains said dispersed cracking catalyst fines;

(c) passing said at least one lower boiling fraction through a hydrocracking unit wherein said at least one lower boiling fraction is converted into lower molecular weight hydrocarbon products; and (d) passing said higher boiling fraction containing dispersed catalyst fines through a catalytic cracking unit wherein said higher boiling fraction is converted into lower molecular weight hydrocarbon products.

19. A process in accordance with claim 18 wherein said feed material comprises a mixture of a slurry oil and a heavy oil which contains metal and sulfur impurities.

* * * * *